United States Patent [19]

Schweikert

[11] 4,228,775

[45] Oct. 21, 1980

[54] CLOSED LOOP AIR/FUEL RATIO CONTROLLER WITH ASYMMETRICAL PROPORTIONAL TERM

[75] Inventor: John F. Schweikert, Sterling Heights, Mich.

[73] Assignee: General Motors Corporation, Detroit, Mich.

[21] Appl. No.: 961,645

[22] Filed: Nov. 17, 1978

[51] Int. Cl.[3] ..... F02M 7/00; F02B 3/00

[52] U.S. Cl. ..... 123/440; 123/489

[58] Field of Search ..... 123/32 EC, 119 EC; 60/276, 285

[56] References Cited

U.S. PATENT DOCUMENTS

| | | | |
|---|---|---|---|
| 4,153,022 | 5/1979 | Asano | 123/119 EC |
| 4,163,433 | 8/1979 | Fujishiro | 123/119 EC |

*Primary Examiner*—Ronald B. Cox

*Attorney, Agent, or Firm*—Howard N. Conkey

[57] ABSTRACT

A closed loop air/fuel ratio controller for an internal combustion engine includes a control circuit responsive to the output of an exhaust gas sensor representing at least the sense of deviation of the air/fuel ratio of the mixture supplied to the engine from stoichiometry and provides a control signal which is used to adjust the air/fuel ratio of the mixture supplied to the engine in direction tending to restore a stoichiometric air/fuel ratio. The control signal includes an integral correction term and an asymmetrical proportional correction term that abruptly shifts the value of the control signal upon a detected change in at least one direction in the sense of the deviation of the air/fuel ratio from a stoichiometric air/fuel ratio. The asymmetrical proportional term provides either singularly or in combination with an asymmetrical integral term a scheduled air/fuel ratio offset from the stoichiometric air/fuel ratio with the offset value being a function of the system gains and the limit cycle frequency of the control signal that is determined primarily by the transport delay through the engine and exhaust system.

1 Claim, 10 Drawing Figures

CLOSED LOOP AIR/FUEL RATIO CONTROLLER WITH ASYMMETRICAL PROPORTIONAL TERM

This invention relates to a closed loop air/fuel ratio controller for an internal combustion engine.

It is generally known that the amount of hydrocarbons, carbon monoxide and oxides of nitrogen present in the exhaust gases emitted from an internal combustion engine may be substantially reduced by controlling the air/fuel ratio of the mixture supplied to the engine and catalytically treating the exhaust gases emitted therefrom. For example, by controlling the air/fuel ratio of the mixture supplied to the engine near the stoichiometric value, a catalytic converter of the three-way type may be utilized to oxidize the carbon monoxide and hydrocarbons and reduce the oxides of nitrogen.

The control of the air/fuel ratio so as to permit catalytic treatment of the exhaust gases generally requires a closed loop controller which senses the condition of the exhaust gases and controls the air/fuel ratio of the mixture supplied to the engine in response to the sensed condition. Typical exhaust gas sensors used in closed loop air/fuel controllers are generally characterized in that they provide an output voltage that shifts abruptly between a high value representing a rich mixture relative to the stoichiometric value and a low level output representing a lean mixture relative to the stoichiometric value. Consequently, the sensor output is generally useful to indicate only the sense of deviation of the air/fuel ratio relative to the stoichiometric value. The output of the oxygen sensor is generally provided to a comparator switch whose output is a high or low value representing the sense of deviation of the air/fuel ratio of the mixture supplied to the engine from the stoichiometric value.

The closed loop air/fuel ratio controller provides a control signal that generally includes an integral correction term in response to the output of the comparator switch which varies at a constant rate in one direction when the air/fuel ratio is leaner than the stoichiometric value and changes at a constant rate in the opposite direction when the air/fuel ratio is greater than the stoichiometric value. This signal is utilized to adjust the fuel delivery system, such as fuel injectors or carburetors, in a direction tending to achieve the stoichiometric value. In some closed loop controllers, the control signal also includes a proportional term which, in response to a shift in the output of the comparator switch, takes the form of a step function which steps the control signal to adjust the air/fuel mixture supplied by the fuel delivery system in a direction tending to achieve the stoichiometric value.

Due to the transport delay between the supplying of an air/fuel mixture to the engine and the sensing of the resulting air/fuel ratio by an exhaust gas sensor, the output of the controller causes the air/fuel ratio of the mixture supplied to the engine to overshoot the stoichiometric air/fuel ratio by an amount determined primarily by the transport delay and the controller gains. Consequently, the control system limit cycles at a frequency determined primarily by the controller time constants and the transport delay. When the integral and proportional terms are symmetrical, i.e., the integral and proportional gains being the same for both sensed lean and rich air/fuel ratios, the system will oscillate in a symmetrical manner about the stoichiometric air/fuel ratio as sensed by the oxygen sensor thereby producing an average stoichiometric air/fuel ratio of the mixture supplied to the engine.

However, it may be desirable to schedule an air/fuel ratio that is offset from the stoichiometric value. For example, the air/fuel ratio may be shifted from the stoichiometric value to improve either the oxidizing or reducing characteristics of the converter during certain engine operating conditions, to provide for improved fuel economy, or to provide for fuel enrichment during high engine load conditions. Additionally, it may be desirable to alter the average value of the control signal from the value producing a stoichiometric mixture in order to compensate for known conditions producing an air/fuel ratio error. For example, the average value of the control signal may be shifted from the value producing a stoichiometric mixture in order to compensate for an air/fuel ratio error introduced in the controller due to the difference between the lean-to-rich and rich-to-lean response times of the air/fuel ratio sensor as the mixture passes through the stoichiometric value.

It has been proposed to provide for an offset in the average value of the control signal provided by the closed loop controller so as to shift the average air/fuel ratio of the mixture supplied to the engine by providing for asymmetrical ramp rates in the integral term output of the controller. This results in the average value of the control signal being shifted from the value producing the stoichiometric mixture by an amount determined by the difference in the ramp rates of the integral term and the limit cycle frequency of the controller output. While the use of asymmetrical integration rates is effective to provide for an air/fuel ratio adjustment, its use in scheduling a varying offset or shift in the air/fuel ratio relative to the stoichiometric value over the engine operating range is limited.

It is one object of this invention to provide a closed loop air/fuel controller for an internal combustion engine wherein the air/fuel ratio is shifted by the provision of an asymmetrical proportional control term.

Another object of this invention is to provide a closed loop air/fuel controller for an internal combustion engine wherein an air/fuel ratio adjustment signal is provided having a control term effecting a scheduled air/fuel ratio shift in response to varying controller limit cycle frequencies and wherein the amount of air/fuel ratio shift for a change in limit cycle frequency varies as a function of the limit cycle frequency.

Another object of this invention is to provide a closed loop air/fuel controller for an internal combustion engine wherein the air/fuel ratio is shifted in response to the change in the sense of the deviation of the air/fuel ratio from a predetermined ratio and in a direction tending to produce the predetermined ratio by an amount that is greater in one direction than a shift provided in the other direction so as to produce an air/fuel ratio varying relative to the predetermined ratio as a function of the limit cycle frequency of the controller.

It is another object of this invention to provide a closed loop air/fuel ratio controller for an internal combustion engine responsive to the sensed exhaust gas conditions to provide a closed loop control signal whose average value varies as a function of the limit cycle frequency of the controller determined primarily by the transport delay time through the engine.

It is another object of this invention to provide for a closed loop air/fuel ratio controller for an internal combustion engine wherein the controller is responsive to the sense of the deviation of the air/fuel ratio of the mixture supplied to the engine from a predetermined ratio to provide a control signal whose average value is shifted from a value producing the predetermined ratio by the combination of asymmetrical integral and proportional control terms.

It is another object of this invention to provide for a closed loop air/fuel ratio controller for an internal combustion engine wherein the air/fuel ratio is scheduled as a function of the engine speed and load by the provision of an asymmetrical proportional control term generated in response to the detected sense of deviation of the air/fuel ratio from a predetermined ratio.

These and other objects of this invention may be best understood by reference to the following description of a preferred embodiment and the drawings, in which.

Figure 1:
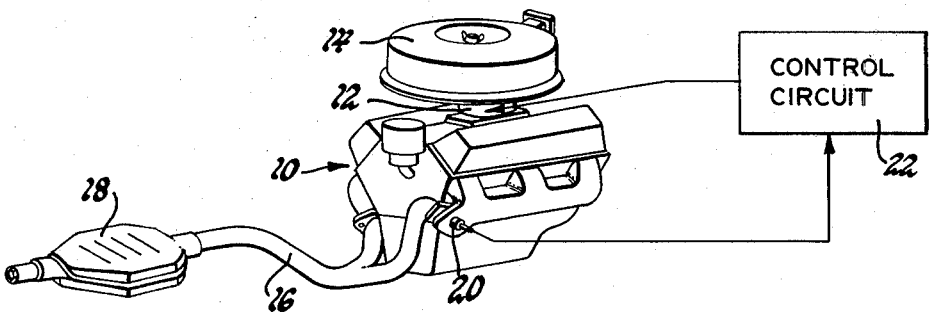
FIG. 1 is the view of an engine with its carburetor and exhaust system and a general control system employing the principles of this invention for controlling the air/fuel mixture supplied by the carburetor to the engine.
Figure 2:
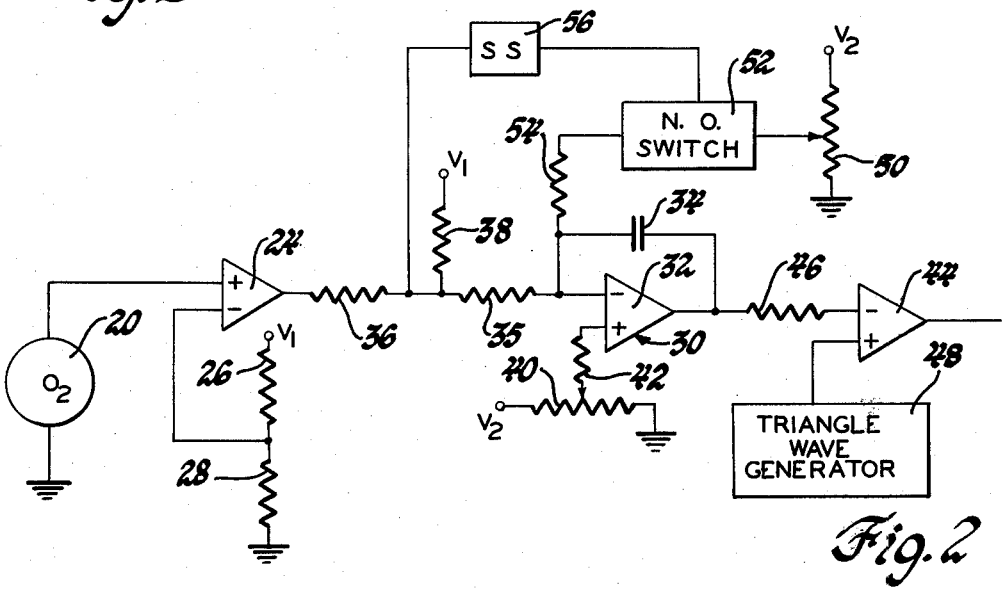
FIG. 2 is a schematic diagram of the control circuit of FIG. 1 for controlling the air/fuel ratio of the mixture supplied by the carburetor in accord with the principles of this invention.
Figure 3A:
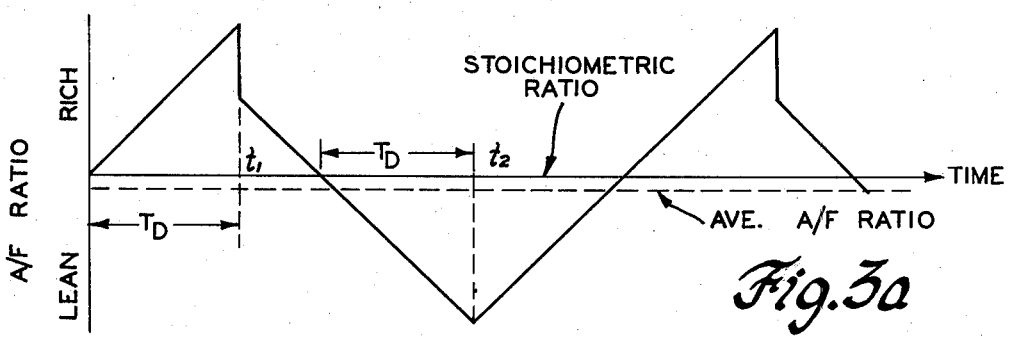
Figure 3B:
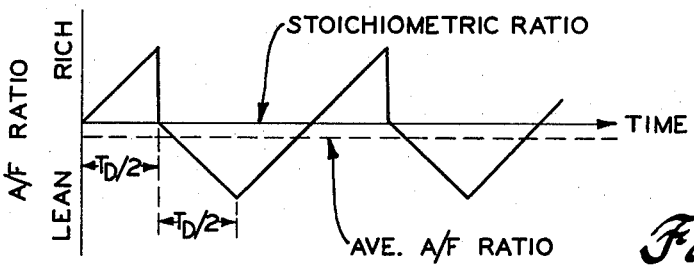
Figure 3C:
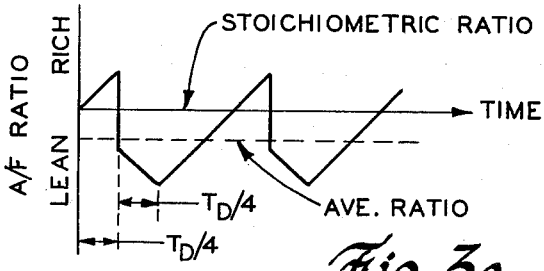
Figure 4B:
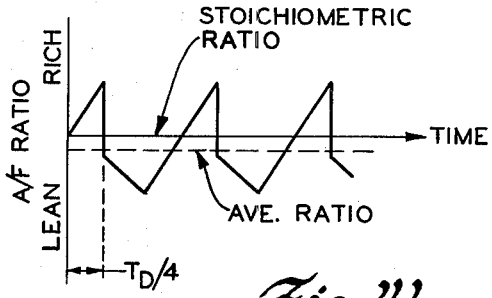
Figure 4A:
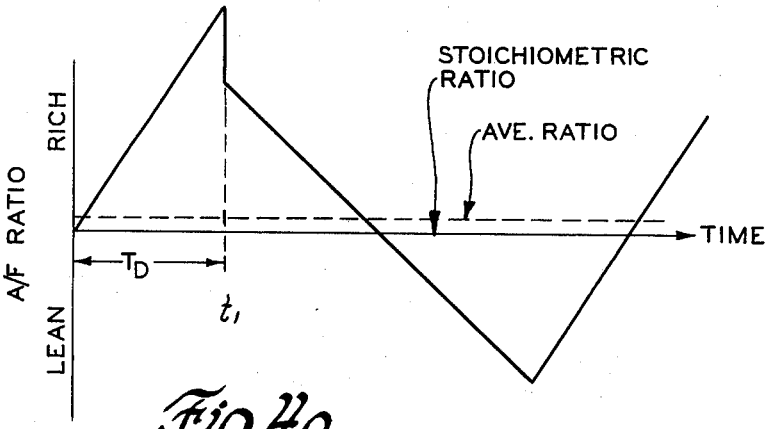
Figure 5:
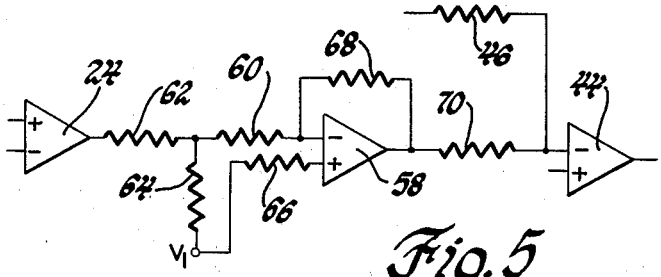
Figure 6B:
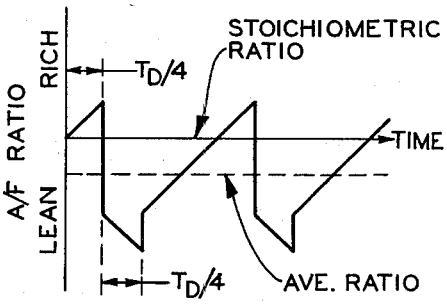
Figure 6A:
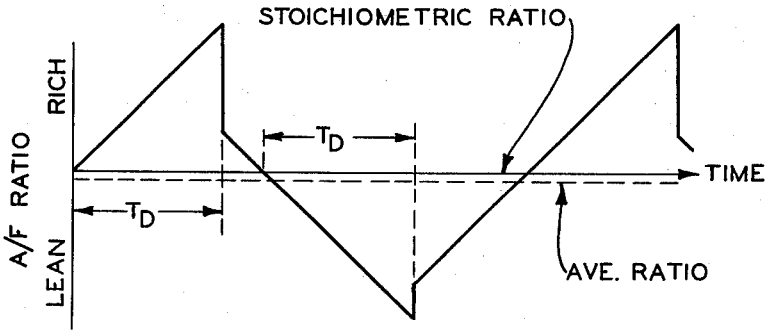

FIGS. 3*a*, 3*b* and 3*c* are diagrams illustrating the operation of the circuit of FIG. 2 in accord with one embodiment of the present invention;

FIGS. 4*a* and 4*b* are diagrams illustrating the operation of the circuit of FIG. 2 in accord with another embodiment of the invention;

FIG. 5 is a schematic diagram of another embodiment of the control circuit of FIG. 1; and FIGS. 6*a* and 6*b* are diagrams illustrating the operation of the circuit of FIG. 5.

Referring to FIG. 1, an internal combustion engine 10 is supplied with a controlled mixture of fuel and air by a carburetor 12. Fuel is supplied to the carburetor 12 via a conventional fuel container and pump means (not illustrated) and air is supplied to the carburetor 12 through an air cleaner 14.

The air/fuel mixture supplied by the carburetor 12 to the engine 10 forms a combustible mixture drawn into the respective cylinders where it undergoes combustion. The combustion byproducts from the engine 10 are exhausted to the atmosphere through an exhaust conduit 16, which includes a catalytic converter 18.

The catalytic converter 18 is preferably of the three-way type wherein carbon monoxide, hydrocarbons and nitrogen oxides can be simultaneously converted if the air/fuel mixture supplied thereto is maintained within a narrow band at the stoichiometric value, the ratio containing fuel and oxygen in such proportions that, in perfect combustion, both would be completely consumed. If the air/fuel ratio deviates from the narrow band at stoichiometry, the converter conversion efficiency of at least one of the undesirable exhaust constituents decreases.

The carburetor 12 is of the conventional type which supplies an air and fuel mixture to the engine 10. However, it is difficult to provide a carburetor which has the desired response to the fuel determining input parameters over the full range of engine operating conditions. Additionally, these systems are generally incapable of compensating for various ambient conditions and fuel variations, particularly to the degree required in order to maintain the air/fuel mixture within the required narrow range at stoichiometry. Consequently, the air/fuel ratio provided by the carburetor 12 in response to the fuel determining input parameters may deviate from stoichiometry during engine operation.

To provide for the control of the air/fuel ratio of the mixture supplied by the carburetor 12 to the engine 10 so as to obtain the desired converter conversion characteristics, an oxygen sensor 20 is provided for sensing the oxidizing/reducing conditions of the exhaust gases upstream from the catalytic converter 18. As illustrated in FIG. 1, the oxygen sensor 20 is positioned at the discharge point of one of the exhaust manifolds of the engine 10 and senses the exhaust discharge therefrom. The sensor 20 is preferably of the zirconia type which, when exposed to engine exhaust gases at high temperature, e.g., 700° F., generates an output voltage which changes abruptly as the air/fuel ratio of the exhaust gases passes through the stoichiometric air/fuel ratio. Such sensors are well known in the art, a typical example being that illustrated in the U.S. Pat. No. 3,844,920 to Burgett et al, which issued on Oct. 29, 1974, and which is assigned to the assignee of the present invention.

The output voltage of the sensor 20 achieves its maximum value when the sensor 20 is exposed to rich air/fuel mixtures and its minimum value when the sensor 20 is exposed to lean air/fuel mixtures. Additionally, the output voltage exhibits an abrupt change between the high and low values as the air/fuel ratio of the mixture passes through the stoichiometric value.

The output of the sensor 20 is coupled to the input of the control circuit 22 which generates a control signal that varies in amount and sense tending to restore the air/fuel ratio of the mixture supplied to the engine 10 by the carburetor 12 to a stoichiometric value. The output of the control circuit may, for example, take the form of a constant frequency, pulse width modulated signal. The carburetor 12 includes an air/fuel ratio adjustment device that is responsive to the control signal output of the control circuit 22 to adjust the air/fuel ratio of the mixture supplied to the engine 10. An example of a carburetor 12 responsive to a pulse width modulated or variable duty cycle signal to adjust the mixture of air and fuel supplied to an engine is illustrated in the U.S. Patent Applications Ser. No. 868,713 filed Jan. 11, 1978 and Ser. No. 869,454 filed Jan. 16, 1978, both of which are assigned to the assignee of this invention. In these applications, the duty cycle modulated control signal is applied to a solenoid which adjusts elements in the fuel metering circuits to provide for air/fuel ratio adjustments.

The control circuit 22 typically includes a comparator switch which is responsive to the output of the oxygen sensor 20 to provide a two-level output signal having a high value when the output of the oxygen sensor is representative of a rich air/fuel mixture and a low value when the output of the oxygen sensor 20 is indicative of a lean air/fuel mixture. The output of the comparator switch may then be supplied to integral plus proportional control circuitry which provides an output having integral plus proportional control terms. As a result of the use of the comparator switch in the control circuit 22, the integral control term output of the control circuit 22 is in the form of a ramp function changing at a constant rate in one direction when the air/fuel ratio is rich and changing at a constant rate in the other direction when the air/fuel ratio is lean. The proportional term takes the form of a step function shifting in the direction tending to restore the air/fuel ratio to stoichiometry upon a sensed transition of the air/fuel ratio between rich and lean values.

A characteristic of the system of FIG. 1 is the transport time delay involved in the induction, combustion and exhaust processes. The engine 10 receives the air/fuel mixture from the carburetor 12 through the intake manifold, burns the mixture, and passes it down through the exhaust manifold past the exhaust sensor 20 and through the catalytic converter 18. Changes in the air/fuel mixture supplied by the carburetor 12 can be observed by the sensor 20 only after the transport time delay. Therefore, the engine has gone rich or lean at some point in time before the sensor 20 sees the error. After the error is sensed, additional time is required for the closed loop control circuit 22 to correct for the sensed error. As a result of these delays, the control signal output of the control circuit 22 causes the air/fuel ratio of the mixture supplied by the carburetor 12 to overshoot the stoichiometric air/fuel ratio by an amount determined by the transport delay, the rate of change of the integral term of the control signal and the magnitude of the proportional step. Consequently, the system limits cycles with an amplitude and frequency determined by the time constants of the control system and the transport delay.

The magnitude of the transport delay is dependent upon engine operating conditions. For example, as the engine speed increases, the transport delay decreases resulting in an increase in the frequency of the controller limit cycle. Also, as the pressure in the intake manifold of the engine 10 increases, the transport delay also decreases, again resulting in an increase in the limit cycle frequency. From this, it can be seen that the limit cycle frequency of the closed loop air/fuel ratio controller varies as a function of engine speed and load.

Assuming symmetrical integral and proportional gains in the control circuit 22, and assuming that the oxygen sensor 22 functions essentially as a switch at a stoichiometric air/fuel ratio, the average value of the control signal provided by the control circuit 22 is a value producing a stoichiometric air/fuel ratio by the carburetor 12. However, as a result of system characteristics, the average air/fuel ratio provided to the engine 10 may be offset from a stoichiometric value. For example, a typical oxygen sensor 20 has a characteristic in that the time response to a lean-to-rich air/fuel ratio is faster than the time response to a rich-to-lean air/fuel ratio excursion. This results in the output of the control circuit 22 adjusting the average air/fuel ratio to a value that is lean relative to stoichiometry. The amount of the lean bias resulting from the asymmetrical characteristics of the oxygen sensor 20 is also a function of the limit cycle frequency of the closed loop fuel controller. As the limit cycle frequency increases, the amount of lean bias resulting from the sensor characteristics also increases.

It may be desired to adjust the average value of the control signal provided by the control circuit 22 in order to shift the average air/fuel ratio of the mixture supplied by the carburetor 12 to compensate for the air/fuel ratio shift provided by the sensor characteristics. Since the shift of the air/fuel ratio provided by the sensor 20 is dependent upon the limit cycle frequency, the adjustment provided to the control signal must then also be limit cycle frequency dependent. Additionally, it may be desirable to provide a scheduled adjustment of the air/fuel ratio relative to stoichiometry over the operating range of the engine 10. The tailoring of the average value of the signal output of the control circuit 22 to provide for compensation and/or scheduling of air/fuel ratio is provided in the control circuit 22 as will hereinafter be described.

Referring to FIG. 2, one embodiment of the control circuit 22 incorporating the principles of this invention is illustrated. The output of the oxygen sensor 20 is coupled to the positive input of a comparator switch 24 which compares the amplitude of the voltage output of the oxygen sensor 20 to a reference voltage applied to its negative input by a voltage divider comprised of a resistor 26 and a resistor 28 coupled between a voltage source $V_1$ and ground. The reference voltage output between the resistors 26 and 28 has a value between the upper and lower saturation voltage levels of the sensor 20 when heated to its operating temperature and equal to the sensor voltage when the sensed air/fuel ratio of the exhaust gases is stoichiometry. The comparator switch 24 provides an output signal which shifts abruptly between a constant low voltage level when the output of the sensor 20 represents an air/fuel ratio greater than stoichiometry and a constant high voltage level when the output of the sensor 20 represents an air/fuel ratio less than stoichiometry.

An integral correction term is provided by a closed loop integrator 30 which includes an operational amplifier 32 and a feedback capacitor 34 coupled between its output terminal and negative input terminal. A signal related to the output of the comparator switch 24 is provided to the negative input of the operational amplifier 32 through a resistor 35. This signal is provided by a voltage divider formed by a resistor 36 and a resistor 38 series coupled between the output of the comparator switch 24 and a voltage source $V_1$. The signal provided at the junction of the resistors 36 and 38 has a value shifting from a value greater than the voltage $V_1$ when the output of the comparator switch 24 is at its high voltage level representing a rich air/fuel mixture and a voltage level less than the value $V_1$ when the output of the comparator switch 24 is at its low voltage value representing a lean air/fuel ratio.

A reference voltage for controlling the integration constant and consequently the ramp rates of the integral term of the control signal provided by the control circuit 22 is provided by a potentiometer 40 coupled between ground potential and a voltage $V_2$. The voltage at the tap of the potentiometer 40 is coupled to the positive input of the amplifier 32 through a resistor 42. The value of the reference voltage provided by the potentiometer 40 is intermediate the voltage values provided by the voltage divider formed by the resistors 36 and 38. When the signal supplied to the negative input of the amplifier 32 is at the upper voltage level during the period when the sensed air/fuel ratio is rich, the integral term output of the closed loop integrator 30 decreases with a constant slope determined by the difference between the values of the voltages supplied to the positive and negative input terminals. When the voltage is at the low voltage level when the sensed air/fuel ratio is lean, the integral term increases with a constant slope determined by the difference between the values of the voltages supplied to the positive and negative input terminals. When the reference voltage supplied to the positive input of the amplifier 32 is at the midpoint between the two voltage levels supplied to the negative input of the amplifier 32, the positive and negative slopes of the integral term are equal thereby producing a symmetrical integral term. However, when the reference voltage differs from the midpoint, the positive and negative slopes of the integral term vary from one another to produce an asymmetrical integral term which is determined by the deviation of the reference voltage from the midpoint. By adjusting the wiper of the potentiometer 40, the asymmetry of the integral term may be controlled so as to provide an average air/fuel ratio of the mixture supplied to the engine 10 by the carburetor 12 to a value which is offset from stoichiometry.

The output of the integrator 30 is coupled to the negative input of a comparator switch 44 through a resistor 46. The comparator switch 44 in conjunction with a triangle wave generator 48 functions as a pulse width modulator or duty cycle oscillator which provides pulses at a constant frequency and variable width as determined by the magnitude of the output signal of the integrator 30. When the output signal of the integrator increases in response to a sensed lean air/fuel ratio by the oxygen sensor 20, the duty cycle of the output signal of the comparator switch 44 decreases. Conversely, when the output signal of the integrator 30 decreases in response to a sensed rich air/fuel ratio, the duty cycle of the output signal of the comparator switch 44 increases. In general, the duty cycle output of the comparator switch 44 may, for illustrative purposes, vary between 10% and 90%, in increasing duty cycle effecting a decreasing fuel flow so as to increase the air/fuel ratio and a decreasing duty cycle effecting an increase in the fuel flow so as to decrease the air/fuel ratio. The range of duty cycle of 10% to 90% may represent a change in four air/fuel ratios at the carburetor 12.

The circuit of FIG. 2 so far described represents conventional closed loop control circuitry for controlling the air/fuel ratio of the mixture supplied to the engine 10. In accord with this invention, an asymmetrical proportional correction term is provided so as to provide an air/fuel ratio that is shifted from the stoichiometric value by an amount determined by the degree of the asymmetrical proportional term and the frequency of the limit cycle of the closed loop control system. To provide for the asymmetrical proportional term, the embodiment of FIG. 2 includes a potentiometer 50 which is coupled between the voltage $V_2$ and ground and which supplies a voltage to the input side of a normally open switch 52. The output side of the normally open switch is coupled to the negative input of the operational amplifier 32 through a resistor 54. The normally open switch, which typically may take the form of a semiconductor switch, is operated to couple a current pulse to the negative input of the amplifier 32 upon the application of a positive voltage coupled to a control terminal thereof by a single-shot multivibrator 56. The single-shot multivibrator 56 is triggered to provide the voltage pulse by the leading edge of the positive transition of the signal provided at the junction of the resistors 36 and 38 which occurs when the output of the oxygen sensor 20 represents a transition from a sensed lean to a sensed rich air/fuel ratio. The time constant of the single-shot multivibrator 56 is chosen so that a current pulse having a predetermined value and duration is injected into the negative input of the amplifier 32 so as to cause a predetermined abrupt shift in the output of the integrator 30. The shift provided when the normally open switch 52 is closed is in the negative direction causing the output of the integrator 30 to abruptly shift in a negative direction. The resulting shift in the duty cycle of the output signal from the comparator switch 44 causes an abrupt shift in the air/fuel ratio provided by the carburetor 12 in a mixture leaning direction. When the oxygen sensor 20 senses a transition in the air/fuel ratio from a value greater than stoichiometry to a value less than stoichiometry, no shift is provided at the output of the integrator 30 so that the proportional term is not provided when the air/fuel ratio changes from lean to rich. The result is an asymmetrical proportional term as illustrated in FIG. 3.

FIG. 3 illustrates the operation of the circuit of FIG. 2 when the integral term provided by the integrator 30 is symmetrical. In FIG. 3*a*, the engine operating conditions are such that the transport delay has the value $T_D$. The proportional step is provided at time $t_1$ when the oxygen sensor 20 represents a change in the air/fuel ratio from a value greater than stoichiometry to a value less than stoichiometry. Additionally, no proportional step is provided at time $t_2$ when the air/fuel ratio transition is from a value less than stoichiometry to a value greater than stoichiometry. This asymmetrical proportional function produces an average air/fuel ratio that is offset from stoichiometry as illustrated.

FIG. 3*b* represents the resulting signal provided at the output of the integrator 30 when the engine conditions such as speed and load increase resulting in a transport delay that decreases to $T_D/2$ thereby increasing the limit cycle frequency. At this frequency, the proportional step function provided when the sensed air/fuel ratio changes from rich-to-lean is the amount required to adjust the carburetor to a stoichiometric air/fuel ratio. As can be seen in FIG. 3*b*, under these conditions, the average air/fuel ratio shift resulting from the asymmetrical proportional term increases from the amount illustrated in FIG. 3*a*.

FIG. 3*c* is illustrative of engine operation resulting in a transport delay that is equal to $T_D/4$. As can be seen, the air/fuel ratio shift from a stoichiometric ratio significantly increases from the value illustrated in FIG. 3*b*.

The air/fuel ratio offset provided by the asymmetrical proportional term changes at a low rate with a decreasing transport delay and increasing limit cycle frequency until the proportional shift is sufficient to cause the air/fuel ratio supplied by the carburetor 12 to attain a stoichiometric value. Upon further decreases in the transport delay, the offset in the air/fuel ratio increases at a more rapid rate with a decreasing transport delay. It is therefore apparent that the proportional shift and resulting shift in air/fuel ratio is dominant at the conditions producing the shorter transport delays beginning at the frequency wherein the proportional shift is sufficient to cause the carburetor to adjust the air/fuel ratio to a stoichiometric value. This provides an additional degree of control in scheduling an air/fuel ratio shift as a function of engine operating conditions not generally achievable by use of only an asymmetrical integral control term.

The operation of the circuit of FIG. 2 is illustrated in FIG. 4 wherein an asymmetrical integral term is provided by adjustment of the potentiometer 40 of FIG. 2. As illustrated in FIG. 4*a*, the asymmetrical integral term is such that an average air/fuel ratio is provided that is less than the stoichiometric value at the engine operating conditions producing the transport delay $T_D$. However, as the engine conditions such as speed change in a sense that decreases the transport delay through the engine thereby increasing the limit cycle frequency, a limit cycle frequency is attained above which the air/fuel ratio shift with an increasing limit cycle frequency becomes dominated by the asymmetrical proportional function. As seen in FIG. 4*b* which is illustrative of engine conditions producing a transport delay of $T_D/4$, the air/fuel ratio shift from stoichiometric value causes the average air/fuel ratio to be greater than stoichiometry. As illustrated in FIGS. 4*a* and 4*b*, by the combination of the asymmetrical integral term and the asymmetrical proportional term, the shift in the air/fuel ratio may be scheduled so that the average air/fuel ratio may vary from a value on one side of stoichiometry to a value on the other side of stoichiometry as the engine operation varies over its operating range with the resulting variation in the transport delay.

The circuit of FIG. 2 provides an asymmetrical proportional term wherein the proportional step is provided only when the sense in the deviation of the air/fuel ratio relative to stoichiometry changes in one direction. FIG. 5 is illustrative of a circuit wherein a proportional step is provided when the sense in the deviation of the air/fuel ratio relative to the stoichiometric value changes in both directions. As seen in FIG. 5, a signal related to the output of the comparator switch 24 is provided to the negative input of an operational amplifier 58 through a resistor 60. This signal is provided by a voltage divider formed by the series coupled resistors 62 and 64 coupled between the output of the comparator switch 24 and the voltage source $V_1$. The voltage signal supplied to the negative input of the amplifier 58 has a value that is greater than the voltage value $V_1$ when the output of the comparator switch 24 is at the positive voltage level representing a rich air/fuel ratio and is a voltage value less than the voltage $V_1$ when the output of the comparator switch 24 is at its low voltage level representing a lean air/fuel mixture.

The voltage at the negative input of the amplifier 58 is compared to the voltage value $V_1$ which is coupled to the positive input of the amplifier 58 through a resistor 66. A gain setting resistor 68 is coupled between the output terminal and negative input of the amplifier 58. The proportional term provided by the amplifier 58 is coupled to the negative input of the comparator switch 44 through a resistor 70 where it is summed with the output from the integrator 30 of FIG. 2. The resulting waveform at the negative input of the comparator switch 44 is a control signal having integral plus asymmetrical proportional terms. The resulting waveform is illustrated in FIG. 6.

In FIG. 6*a*, the transport delay through the engine is the value $T_D$ resulting in an air/fuel ratio shift from the stoichiometric value as illustrated. The proportional shift is greater in the rich-to-lean direction than in the lean-to-rich direction producing the indicated offset. In FIG. 6*b*, the transport delay is $T_D/4$ resulting in the increased offset in the air/fuel ratio in the lean direction.

The provision of an asymmetrical proportional control term in a closed loop air/fuel ratio control system either singularly or in conjunction with an asymmetrical integral term provides for adjustment of the air/fuel ratio of the mixture provided by the carburetor in accord with a predetermined schedule as the engine operating conditions change. Depending upon the direction of the asymmetry, the air/fuel ratio may be offset either rich or lean from the stoichiometric value.

The foregoing description of the invention for the purposes of illustrating the invention is not to be considered as limiting or restricting the invention, since many modifications may be made by the exercise of skill in the art without departing from the scope of the invention.

The embodiments of the invention in which an exclusive property or privilege is claimed are defined as follows:

1. An air/fuel mixture control system for an internal combustion engine having combustion space into which an air/fuel mixture is supplied to undergo combustion and having means defining an exhaust passage from the combustion space into which spent combustion gases are discharged and directed to the atmosphere comprising, in combination:

an air/fuel mixture supply means effective to supply a mixture of fuel and air to the combustion space;

sensor means effective to sense the oxidizing/reducing conditions at a predetermined point in the exhaust passage and hence, after a transport delay period dependent upon engine operating conditions, to the mixture supplied to the combustion space, the sensor means providing a sensor signal indicative of the sense of deviation of the air/fuel ratio of the mixture supplied to the combustion space from a predetermined ratio;

a control circuit responsive to the sensor signal effective to generate a control signal; and means effective to control the air/fuel ratio of the mixture supplied by the air/fuel mixture supply means in accord with the instantaneous value of the control signal, the control circuit including an integrator responsive to the sensor signal effective to provide an asymmetrical integral term portion of the control signal to effect a shift in the average value of the control signal in one direction from the value producing the predetermined ratio by an amount dependent in part by the value of the transport delay and a proportional circuit effective to provide an asymmetrical proportional term portion of the control signal to effect a shift in the average value of the control signal in the direction opposite said one direction by an amount dependent in part upon the value of transport delay, the shift in the average value of the control signal being dominated by the asymmetrical integral term portion of the control signal at large values of the transport delay and the shift in the average value of the control signal being dominated by the asymmetrical proportional term portion of the control signal at small values of the transport delay so that the average value of the air/fuel ratio of the mixture supplied to the engine varies from the predetermined ratio in one sense changing to the opposite sense as the engine operating conditions change thereby varying the transport delay through the engine between high and low values to thereby effect a scheduled offset in the air/fuel ratio in accord with engine operating conditions.

* * * * *